United States Patent [19]

Langen

[11] 4,441,303

[45] Apr. 10, 1984

[54] CARTON-CLOSING MACHINE

[75] Inventor: Marinus J. M. Langen, Rexdale, Canada

[73] Assignee: H. J. Langen & Sons Limited, Mississauga, Canada

[21] Appl. No.: 345,549

[22] Filed: Feb. 3, 1982

[51] Int. Cl.[3] ..... B65B 7/24

[52] U.S. Cl. ..... 53/374

[58] Field of Search ..... 53/374, 377, 48, 382, 53/284; 493/136, 137, 139, 390, 179, 183, 182, 163, 319

[56] References Cited

U.S. PATENT DOCUMENTS

| | | | |
|---|---|---|---|
| 2,698,559 | 1/1955 | Harkess | 53/374 |
| 2,953,884 | 9/1960 | Galloway | 53/377 |
| 2,979,876 | 4/1961 | Galloway | 53/374 |
| 3,049,847 | 8/1962 | Galloway | 53/374 |
| 3,306,004 | 2/1967 | Galloway | 53/374 |

*Primary Examiner*—Robert L. Spruill
*Assistant Examiner*—Donald Studebaker
*Attorney, Agent, or Firm*—Fetherstonhaugh & Co.

[57] ABSTRACT

A dynamic setting and tucking mechanism for setting and tucking the closure tab of a carton in a carton-closing station of a carton-loading machine is described. The mechanism includes a plurality of setting blades mounted on an endless chain for movement through the setting and tucking station and a plurality of tucking blades mounted on an endless chain for movement through the setting and tucking station. The setting blades engage the closure tab of a carton and bend it along its hinged connection with the closure flap of a carton and the tucking blades push the set tab into the opening in the end of the carton which is designed to receive the tabs.

8 Claims, 7 Drawing Figures

CARTON-CLOSING MACHINE

This invention relates to improvements in a carton-closing machine. In particular, this invention relates to the provision of a dynamic setting and tucking mechanism for setting the tabs of the closure panel of a carton and tucking the tabs of the closure panel of a carton into a closed position in the end of a carton.

PRIOR ART

The most inexpensive closure of a carton is achieved using tabs on the end of the closure panel which are inserted within the open end or openings in the end of a carton to secure the closure panel in a closed position. Difficulty is, however, experienced in obtaining a reliable closure of the carton during the carton-loading operation using this carton construction. Because of these difficulties, some users prefer to employ alternative carton constructions including the use of adhesives for securing the closure panels in a closed position. The mechanism required for closing by adhesives is, however, more complex and expensive than that required for tab closures.

The mechanism commonly used for the purposes of closing the end of a carton by means of closure tabs which are connected to the closure panel includes a series of static plough blades which sequently plough the various panels to the closed position including aesthetic plough blade for the purposes of ploughing the tab to a set position with respect to its closure panel and aesthetic blade for ploughing the set tab into its retaining passage. Numerous attempts have been made to design ploughs to effectively position the closure tab. However, seating problems continue to plague the industry. One of the main problems is that the tabs must be relatively short so as to be insertable in the openings which are provided and, in the interests of economy, the paperboard from which the cartons are manufactured is of as light a weight as possible. The light weight and the size of the closure tabs are such that the drag applied to the tabs during passage along the plough blades tends to cause distortion of the tabs before they reach the tucking position with the result that they are not in the correct position for insertion. This problem is further complicated by the fact that the surface coating which is applied to the paperboard which is generally a wax coating tends to build up on the stationary plough blades and the build-up of coating further complicates the closing procedure.

I have found that many of the problems described above can be overcome if the setting and tucking of mechanisms are dynamic thereby eliminating or substantially eliminating relative movement between the plough mechanism and the closure tab during the setting and tucking operations.

SUMMARY OF INVENTION

According to one aspect of the present invention, there is provided in a carton closing machine for closing a closure panel which is hingedly connected along a first hinge line to an open end of a carton, the closure panel having a closure tab hingedly connected thereto along a second hinge line, the closure tab being insertable within an opening in the open end of the carton to retain the closure panel in a closed position, said machine having a final closing station in first section of which the closure tabs are initially set by bending along the second hinge line and in a second section of which the tabs are tucked into the open end of the carton, said machine also having a primary conveyor for conveying cartons through the final closing station with the open ends of the cartons being continuously driven in a closure path in which the openings extend in a tucking plane, the improvement of: first and second plough means in said first section, said first plough means being arranged to fold the closure panel about said first hinge line to an intermediate position, said second plough means being arranged to underlie said second hinge line when the closure panels are in the intermediate position, a dynamic setting and tucking mechanism for setting and tucking said tabs comprising: a plurality of setting members mounted for movement through the first section at a forward velocity substantially equal to that of the primary conveyor, a plurality of tucking members mounted for movement through the second section at a forward velocity substantially equal to that of the primary conveyor, first activating means adapted to activate the setting members as they are driven through said first section to cause the setting members to initially move laterally toward the closure plane to engage a carton tab and bend it over said second plough means along its second hinge line to its set position in which it is directed toward the open end of its associated carton, second activating means adapted to activate the tucking members as they are driven through the said second section to cause the tucking members to move laterally toward the closure plane to engage the closure panel and move it toward the closure path and thereby cause the tab to be driven into said openings to close the carton.

The invention will be more clearly understood after reference to the following detailed specification read in conjunction with the drawings wherein.

Figure 1:
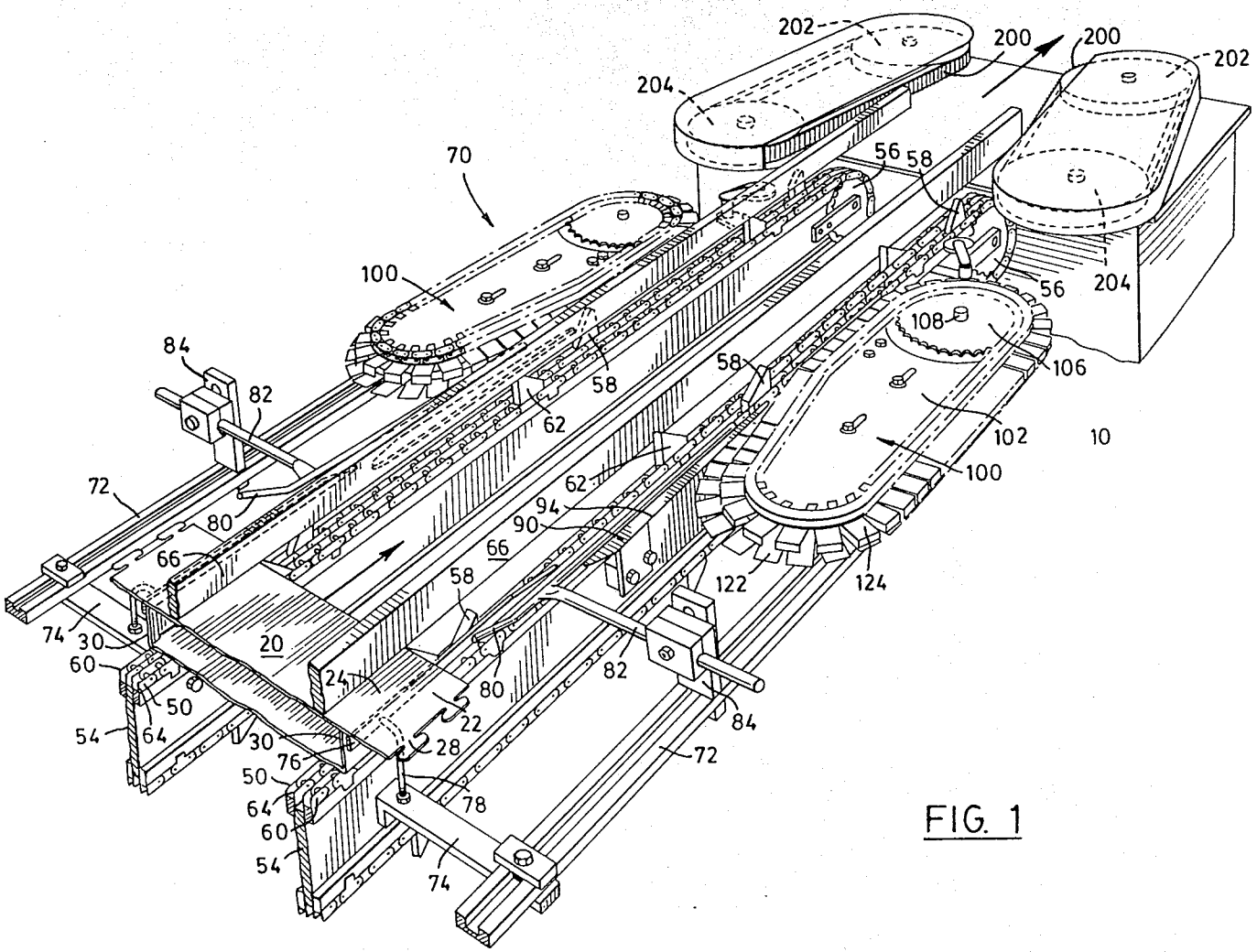
FIG. 1 is a pictorial view of a carton-closing station of a carton loading machine constructed in accordance with an embodiment of the present invention.

With reference to the FIG. 1 of the drawings, the reference numeral 10 refers generally to a carton closing section of a carton loading machine. The carton loading mechanism forms no part of the present invention and will not, therefore, be described.

Figure 7:
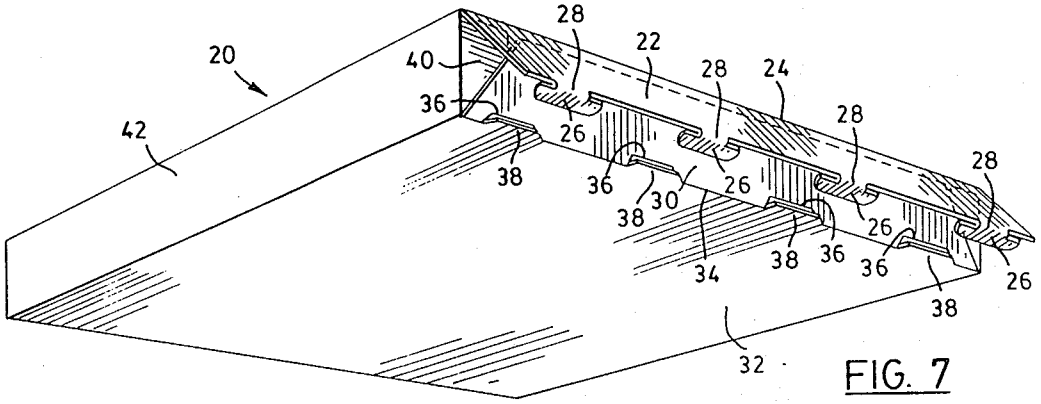
FIG. 7 is a pictorial view of one end on the underside of a carton of the type which may be closed by the mechanism of the present invention.

The carton-closing mechanism of the present invention will be described and illustrated in a form suitable for closing a carton of the type identified by the reference numeral 20 in FIG. 7 of the drawings to which reference is made. As shown in FIG. 7, the carton 20 is an end closure carton which has a closure panel 22 hingedly connected to an upper wall along a first hinge line 24. Closure tabs 26 are connected to the closure panel 22 along second hinge lines 28. An inner closure wall panel 30 is connected to the bottom wall 32 along a third hinge line 34. Openings 36 are formed in the inner end wall 30 and open inwardly to the open end of the carton above a narrow lip 38. End flaps 40 are connected to the end walls 42 of the carton and are folded inwardly to underlie the end walls 30 and 22.

The carton-closing machine has a pair of primary conveyors 50 each of which consists of two chain members mounted for movement along guide plates 54. The chains 50 extend around sprockets 56 at one end thereof and around further driven sprockets (not shown) at the other end thereof. Carton pusher members 58 are mounted on chains 60 and retainer blades 62 are mounted on chains 64. The carton pusher blades 58 serve to push the carton along the chain through the closing station and the retainers 62 prevent forward movement of the containers relative to the conveyor in use.

The conveyors 50 extend through the final closing station generally identified by the reference numeral 70 to drive the open ends of the cartons 20 along closure paths extending at opposite sides of the carton-closing station. Top rails 66 extend above the carton-closing station so as to retain the cartons against upward movement during passage through the closing station. The top rails 66 are supported by suitable supports (not shown).

The end flaps 40 of the carton are tucked inwardly by means of any conventional tucking mechanism prior to entry into the final closing station. Similarly, the end wall 30 is folded along its hinge line 34 by a suitable plough means downstream of the final closing station to the position shown in FIG. 1 of the drawings.

Figure 2:
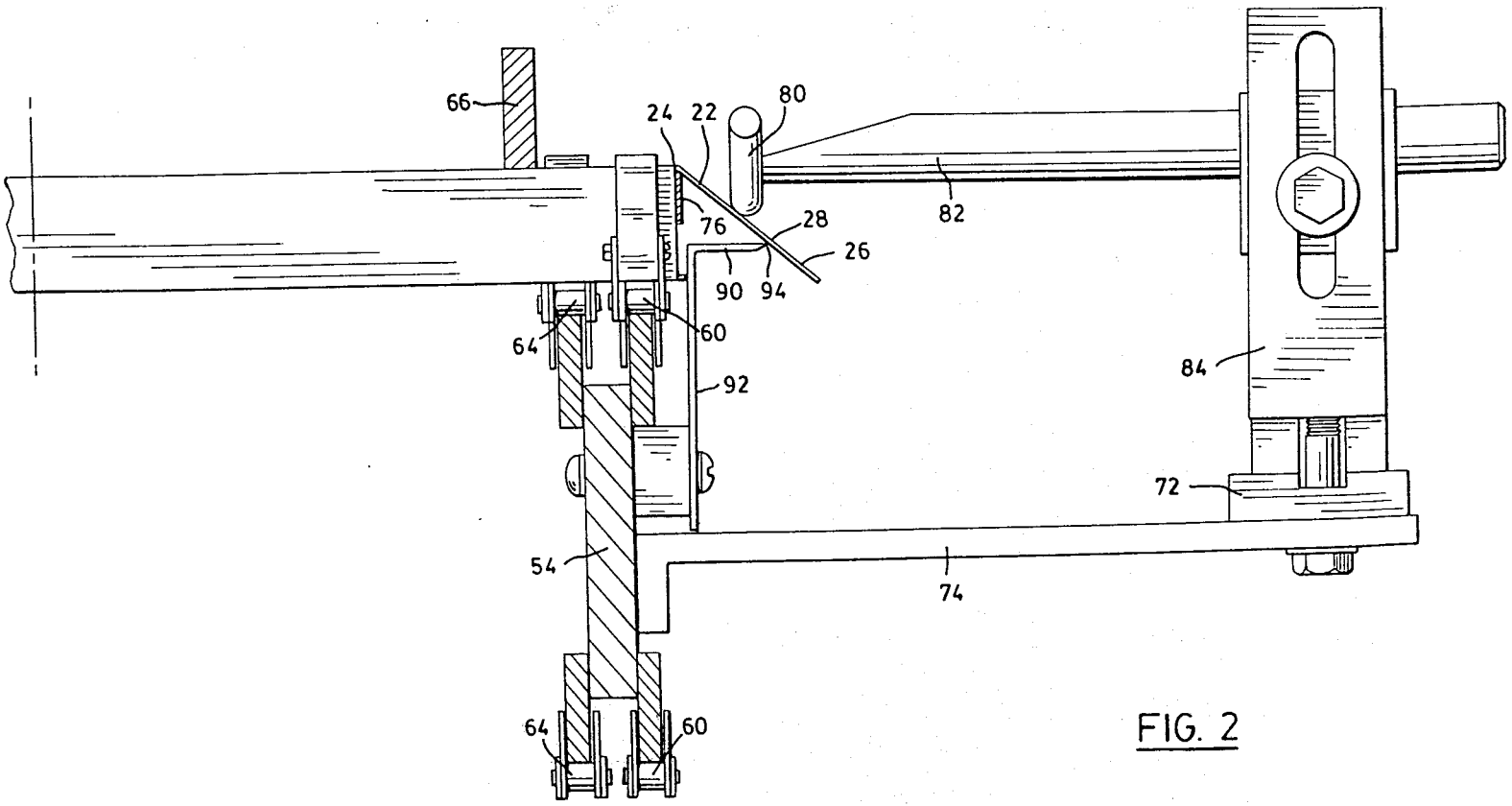
FIG. 2 is a sectional view taken along the line 2—2 of FIG. 1 illustrating the closure panel of a carton in a first hinged position.

A pair of outrigger support rails 72 are supported by brackets 74 which are mounted on the support rails 54 and project laterally therefrom. In order to provide a bending edge over which the closure panels 22 may be folded along their hinge line 24, a rail 76 supported on a post 78 which is mounted on the bracket 74 so as to be positioned to underlie the hinge line 24 of a carton passing through the closure station. Plough bars 80 are mounted on support bars 82 which are supported by brackets 84 mounted on outrigger rails 72. The plough bars 80 form the first plough means arranged to fold the closure panel 22 about its first hinge line 24 to an intermediate position as shown in FIG. 2 of the drawings. The plough bar 80 is height and laterally adjustable by means of the bracket 84 and is longitudinally adjustable along the length of the outrigger rail 72.

A folding ledge 90 is formed at the upper edge of a rail 92 which is mounted on the support rails 54. The ledge 90 has an outer folding edge 94 which underlies the second hinge line 28. The folding edge 94 is inwardly and downwardly inclined in the downstream direction so as to facilitate setting of the tabs 26 along the hinge line 28.

Figure 3:
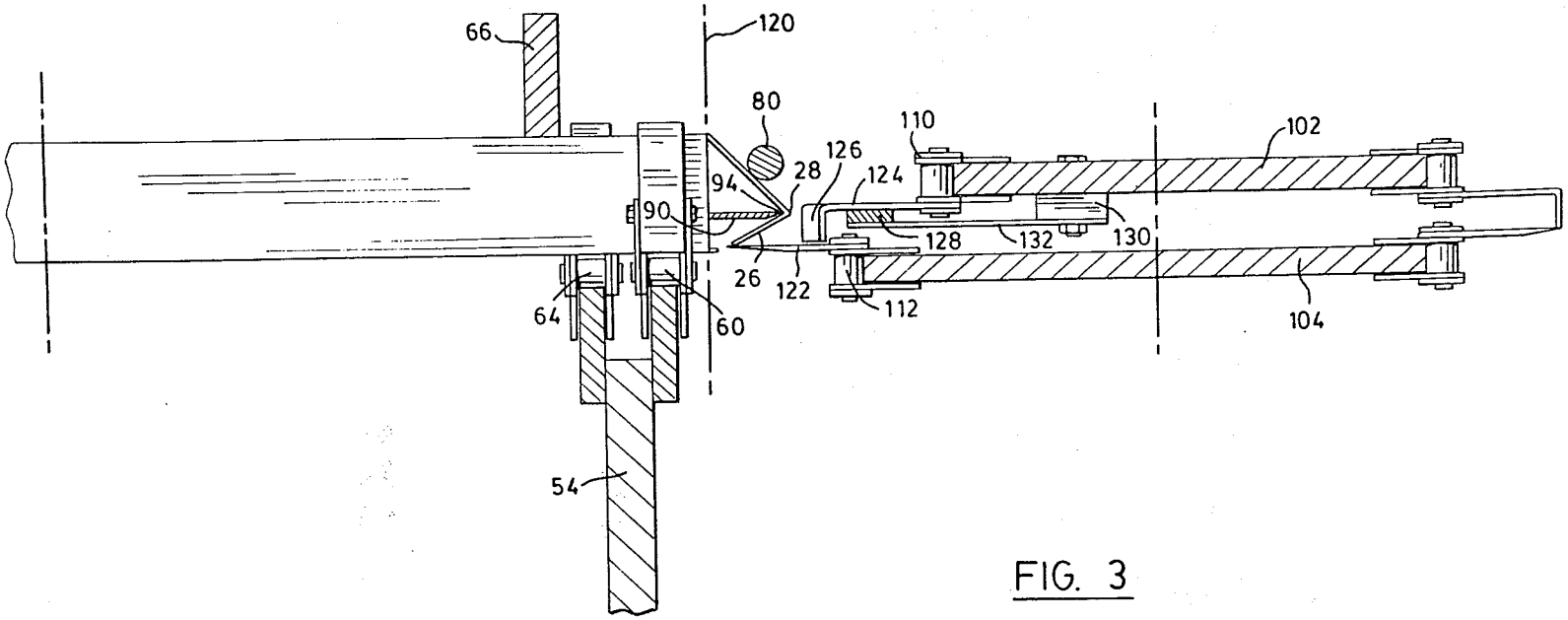
FIG. 3 is a sectional view taken along the line 3—3 of FIG. 1 showing the closure tab in a set position.
Figure 4:
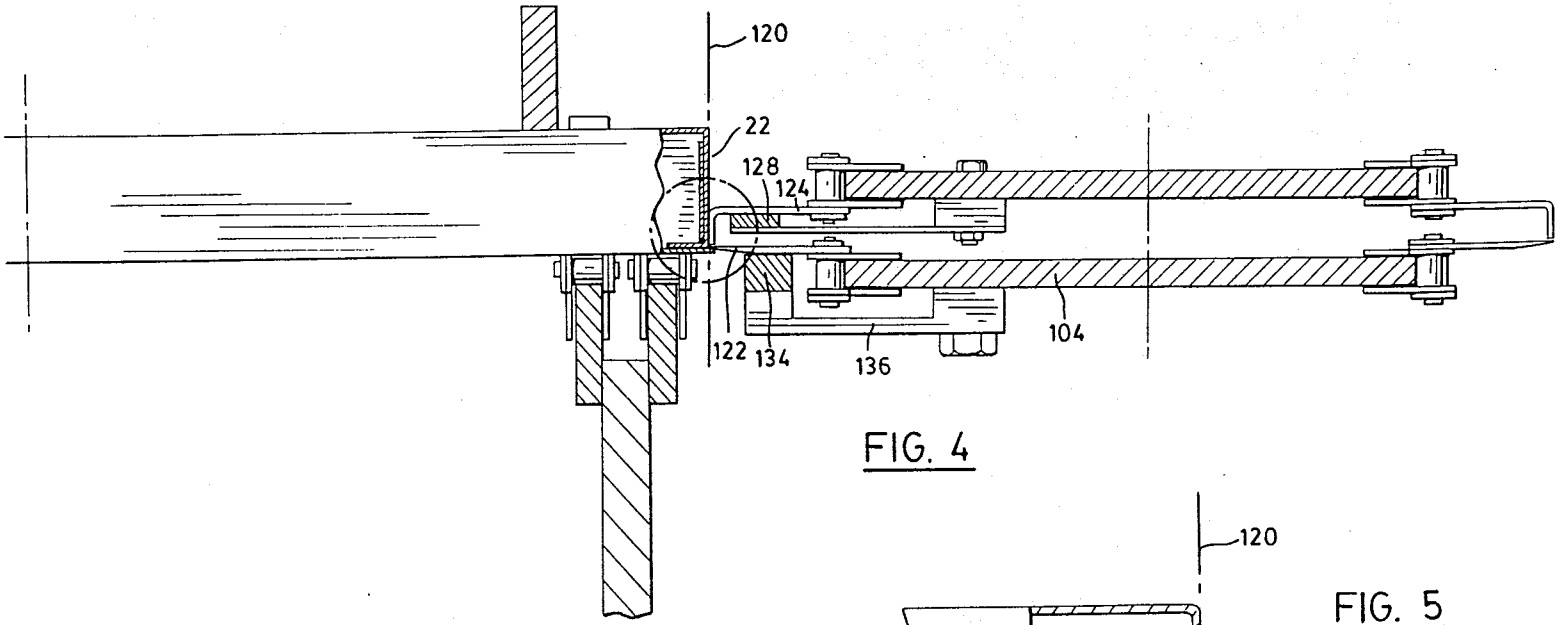
FIG. 4 is a sectional view taken along the line 4—4 of FIG. 1 showing the tab in a tucked position.
Figure 6:
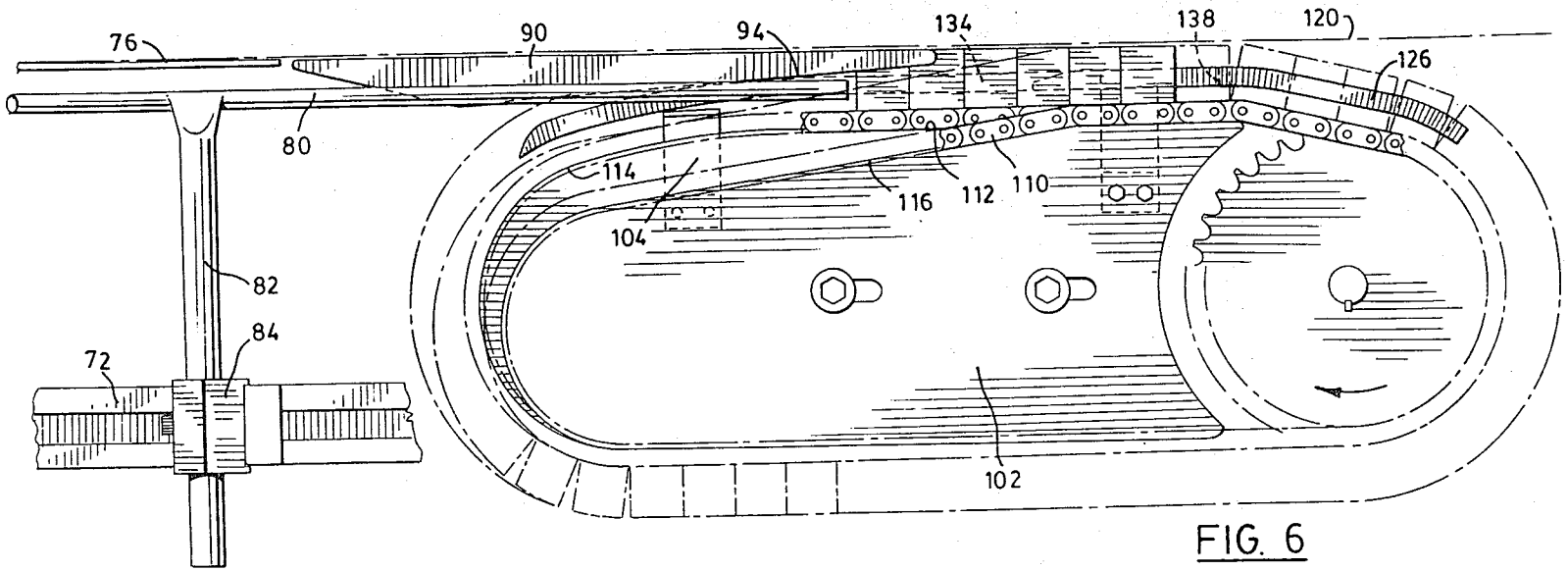
FIG. 6 is an enlarged plan view of one of the dynamic setting and tucking mechanisms of the present invention.

The dynamic setting and tucking mechanism of the present invention is generally identified by the reference numeral 100. Each dynamic setting and tucking mechanism comprises an upper cam track plate 102 and a lower cam track plate 104 (FIGS. 3 and 6). The cam track plates 102 and 104 are mounted on an underlying support (not shown) which may be in the form of a bracket mounted on the guide rails 54 or a ground supported pedestal. A pair of sprockets 106 are keyed to a drive shaft 108 which is connected to the main power source in any suitable manner. The side edges of the cam plates 102 and 104 form guide rails along which a first endless chain 110 and a second endless chain 112 are guided. The lower guide plate 104 has an inner side edge 114. The upper guide plate 102 has an inner side edge 116. The inner side edge 114 of the lower guide plate extends toward the closure plain 120 in advance of the edge 116 of the upper plate. A plurality of setting blades 122 are mounted on the lower chain 112 and project laterally therefrom. The blades 122 are in the form of narrow sheet metal fingers which are rivetted directly to the chain links. Pusher blades 124 are mounted on the upper chain 110 and project laterally therefrom. The pusher blades 124 have a downwardly projecting arm portion 126 at the outer end thereof which projects downwardly toward the lower blades 122.

The pusher blades 126 are supported during their travel through a major portion of the tucking section of the closure station by a platform bar 128 which is supported by an arm 132 which is mounted on a spacer block 130 which is secured to the underside of the plate 102. Similarly, a support platform 134 is supported by an arm 136 which is mounted on the underside of the plate 104. The platform 134 extends through the setting portion and has a terminal end 138 underlying the platform 128. Thus, the platforms 128 and 134 serve to provide underlying support for the tuck blades 124 and the set blades 122 during a major portion of the operation.

The side edges of the cam plates 102 and 104 are designed to provide a camming surface for the chains 110 and 112 as they are driven therealong. The edges 114 and 116 which extend in the direction of the forward run extend in a path such that the setting blades 122 initially project a substantially distance beyond the tucking blades 124 and, subsequent to initial setting of the tabs, the tucking blades will be advanced to engage the set closure panel and push it into its associated passage 36. It will be noted that the edge 114 of the lower plate continues to move toward the closure plane 120 until it extends to overlie the lip portions 38 of the carton passing through the closure station.

The setting blades 122 and tucking blades 124 are, preferably, made from a sheet metal material, such as stainless steel or the like, having sufficient rigidity to cause setting of the paperboard along the hinge lines and tucking of the tabs into their associated openings without deflection thereof.

Figure 5:
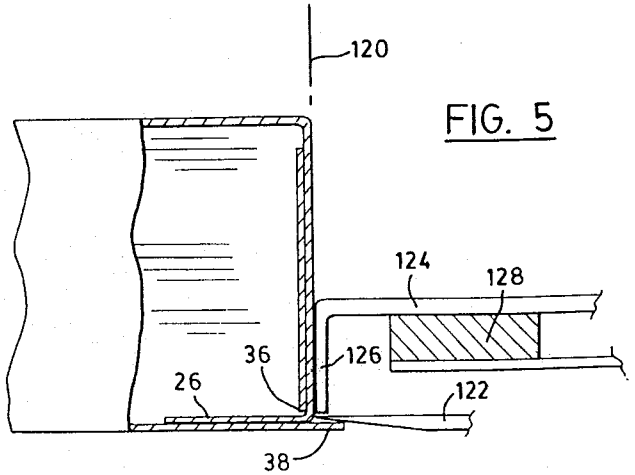
FIG. 5 is an enlarged detail view of the portion A of FIG. 4 showing the final tuck position.

In use, open-ended cartons are mounted on the primary conveyor and loaded. The end flaps 40 of the carton are, then, tucked in by conventional tucker mechanisms and the inner side wall 30 is folded upwardly by means of a conventional plough blade the downstream portion of which may form the underlying support 76. The support 76 provides a bending edge over which the closure panel 32 is folded along hinge line 24 as shown in FIG. 2 of the drawings. The bending edge 94 of the support ledge 94 underlies the hinge line 28 when the closure panel is in its intermediate position. Continued movement of the carton through the closure station brings the setting blades 122 into contact with the tabs 26, as shown in FIG. 3 of the drawings, causing the tabs 26 to bend about their hinge line 28 along the bending edge 94. Once the tab 26 has been moved to the set position illustrated in FIG. 3, further movement of the carton through the closure station causes the tucker blades 128 to engage the closure panel 22 and, simultaneously, causes the setting blade 122 to move forward to underlie the lip 38 shown in FIG. 5 of the drawings.

Continued movement of the carton through the closure station causes withdrawal of the tucking end setting blades thereby allowing the closed cartons to be discharged.

The cartons are discharged by engagement with belts 200 mounted one on either side of the discharge end of the conveyor. The belts 200 are rotatably driven on pulleys 202 and 204 so as to impart a linear speed to the carton which is greater than the speed of continuous movement of the primary conveyors whereby the closed packages are accelerated away from the discharge end of the carton-closing machine.

From the foregoing, it will be apparent that the setting blades and tucking blades move continuously through the final closure station as does the carton 20 which is being closed. The speed-up movement of the setting and tucking blades is such that it closely matches the forward speed of the cartons with the result that the relative movement between the setting and tucking blades and the end closure flaps is minimised. The dynamic carton-closing mechanism provided by these setting and tucking fingers serves to provide a positive setting and tucking of the tabs. The fact that the setting and tucking blades are driven through the closing station at a forward speed which is substantially equal to that of the carton, there is little or no drag applied to the end closure wall and closure tabs unless there is little or no tendency for the tabs or flaps to be distorted. The absence of distortion of the tabs during movement through the closing station facilitates the entry of the tabs into their mounting passage. By extending the setting blade so that it overlies the lip formed at the lower end of the mounting passages, the tab is guided into the passage above the lower wall thus preventing the tab from passing underneath the lower wall and thus missing the mounting passage.

The fact that little or no relative movement occurs between the surface of the paperboard and the tucking and setting blades, there is little or no accumulation of the surface material of the paperboard on these blades.

Various modifications of the present invention will be apparent to those skilled in the art without departing from the scope of the invention. For example, the dynamic setting and tucking mechanism of the present invention could be used for the purposes of closing a carton in which the closure tab extended along the full length of the edge of the closure flap and was inserted into the open end of the carton rather than narrow slots.

Various other modifications of the invention will be apparent to those skilled in the art.

It will be apparent that the machine of the present invention may be used for the purpose of closing containers, such as cardboard boxes, plastic containers, containers made from corrugated paperboard or rigid and semi-plastic material all of which are considered to be cartons within the meaning of the term as used in the present specification.

What I claim as my invention is:

1. In a carton closing machine for closing a closure panel which is hingedly connected along a first hinge line to an open end of a carton, the closure panel having a closure tab hingedly connected thereto along a second hinge line, the closure tab being insertable within an opening in the open end of the carton to retain the closure panel in a closed position, said machine having a final closing station in first section of which the closure tabs are initially set by bending along the second hinge line and in a second section of which the tabs are tucked into the open end of the carton, said machine also having a primary conveyor for conveying cartons through the final closing station with the open ends of the cartons being continuously driven in a closure path in which the openings extend in a tucking plane, the improvement of;

(a) first plow means in said first section, said first plow means being arranged to fold the closure panel about said first hinge line to an intermediate position, folding edge means having a folding edge arranged to underlie said second hinge line when the closure panels are in the intermediate position, (b) a dynamic setting and tucking mechanism for setting and tucking said tabs comprising;

(I) a plurality of setting members mounted for movement through the first section at a forward velocity substantially equal to that of the primary conveyor, (II) a plurality of tucking members mounted for movement through the second section at a forward velocity substantially equal to that of the primary conveyor, (III) first activating means adapted to activate the setting members as they ae driven through said first section to cause the setting members to initially move laterally toward the closure plane to engage a carton tab and bend it over said folding edge along its second hinge line to its set position in which it is directed toward the open end of its associated carton, (IV) second activating means adapted to activate the tucking members as they are driven through the said second section to cause the tucking members to move laterally toward the closure plane to engage the closure panel and move it toward the closure plane and thereby cause the tab to be driven into said openings to close the carton.

2. A carton closing machine as claimed in claim 1 wherein said setting members each comprise a short setting blade, said setting blade being mounted side-by-side on an endless chain and having an outer edge for engaging the closure tabs to set them in use.

3. A carton closing machine as claimed in claim 2 wherein said setting members have an extent in the direction of longitudinal movement which is no greater than that of the opening in the open end of the carton into which the tab is to be inserted.

4. A carton closing machine as claimed in claim 1 wherein said tucking members each comprise a short tucking blade, said tucking blades being mounted side-by-side on an endless chain.

5. A carton closing machine as claimed in claim 1,2 or 3 wherein said tucking members each comprise a short tucking blade, said tucking blades being mounted side-by-side on an endless chain and having an extent in the direction of longitudinal movement of which is substantially equal to that of said setting members.

6. A carton closing machine as claimed in claim 2 wherein said setting members are mounted on a first guide rail which extends through said first section and has a first extent which is inclined towards said closure path to locate the setting members in the closure path to set the tabs along the second hinge line and a second extent parallel to said closure path.

7. A carton closing machine as claimed in claim 6 wherein said tucking members are mounted on a second guide rail which extends through said second section and has a first extent which is inclined towards said closure path to locate the tucking members in the closure path downstream from the setting position to tuck the tabs after setting thereof and a second extent which extends parallel to said closure path to retain the tabs in their respective openings.

8. A carton closing machine as claimed in claim 6 or 7 wherein said first guide rail extends in a guide plane which is inclined toward said tucking plane whereby the setting blades are guided away from said second plow to said tucking plane, after setting of their associated tab, to extend through said second section proximate said tucking opening to underly the tabs during their insertion into their associated opening.

* * * * *